United States Patent [19]

Brimer

[11] 3,991,567

[45] Nov. 16, 1976

[54] VORTICAL FLOW EXHAUST GAS REACTOR

[76] Inventor: Claude Morris Brimer, 4345 N. Camino Cardenal, Tucson, Ariz. 85716

[22] Filed: May 21, 1975

[21] Appl. No.: 579,482

[52] U.S. Cl. ..... 60/303; 60/307; 23/277 C

[51] Int. Cl.[2] ..... F01N 3/10

[58] Field of Search ..... 60/303, 307, 282; 23/277 C

[56] References Cited

UNITED STATES PATENTS

| | | | |
|---|---|---|---|
| 3,073,684 | 1/1963 | Williams | 60/303 X |
| 3,577,728 | 5/1971 | Von Brimer | 23/277 C |
| 3,741,730 | 6/1973 | Alcott | 60/303 X |
| 3,805,523 | 4/1974 | Tanasawa | 60/307 X |

*Primary Examiner*—Carlton R. Croyle
*Assistant Examiner*—Thomas I. Ross
*Attorney, Agent, or Firm*—Robert C. Smith

[57] ABSTRACT

An exhaust gas processing device for use with internal combustion engines is disclosed which is generally of the afterburner type, including a cylindrical reactor in which unburned carbon monoxide (CO) and hydrocarbons are consumed and an exhaust pipe connected near one end of the cylindrical reactor in such manner as to direct the flow of gases tangentially into the reactor to produce a vortical flow pattern. Additional air for combustion is supplied by means of an engine-driven air pump, and this air flow is also directed into the reactor chamber in a manner to produce a vortical flow pattern which is combined with the vortical flow of exhaust gases. An ignition device such as a spark plug is supplied at the upstream end of the reactor chamber to assure ignition of the exhaust gas mixture. Flame propagation is maintained through the use of annular internal baffles or flame holders exposed to the ignited gases and which become very hot and operate somewhat similarly to glow plugs. The vortical flow is directed through a first cylindrical chamber for essentially the length of the reactor, then through a tangential passage into a second cylindrical chamber of similar length which directs the flow in the opposite direction. Gas flow emanating from the second chamber enters a third chamber which forms a jacket around both of the first and second cylindrical chambers, abutting against an end wall and again being redirected parallel to the flow through the first such chamber, but on the outside of the cylindrical members defining the first and second chambers in such manner as to retain heat in such chambers to assure thorough burning of combustibles in the gas before it is exhausted to the atmosphere.

9 Claims, 5 Drawing Figures

VORTICAL FLOW EXHAUST GAS REACTOR

BACKGROUND OF THE INVENTION

Air pollution from automobile exhaust has grown progressively more serious with the increasing number of automobiles in use. Perhaps the major contributor is unburned hydrocarbons which are emitted during all engine operation, but are particularly heavy during idle, acceleration and deceleration operating regimes. Other air pollution products which are known to emanate from combustion engines are carbon monoxide and nitrous oxides (commonly designated as $NO_2$ and collectively as NOX). One of the techniques which has been used to effect a reduction in emissions is to build engine mufflers including catalytic reactors, the catalyst used being typically a screen or exposed surface of a catalytic metal or compound such as vanadium or platinum or their oxides which aid in the combustion of the hydrocarbons. These devices have generally not been fully satisfactory, since the catalytic elements have tended to become poisoned by the pollutants or by the substances in the fuel, such as lead compounds, reducing their effectiveness in the cumulative process. Recent efforts to reduce or minimize lead in gasoline have been directed toward meeting this problem, but life of such catalytic elements is still definitely limited and periodic replacement is certainly an undesirable expense.

Another device which has been used to oxidize unburned carbon monoxide and hydrocarbons in exhaust devices is the afterburner. Afterburners, as they have been used in the prior art, are somewhat effective in reducing emissions, but, depending upon their particular configuration, suffer from a number of shortcomings and thus have never really proved sufficiently successful to become marketable. Control of temperatures has been a problem, and excessive temperatures have tended to cause unacceptably short life. While provisions have been made for providing air for combustion, this has usually not been controlled adequately. Frequently the resulting devices have been too heavy and bulky for reasonable installations and acceptable costs, especially where adequate means are included to insure acceptable exhaust temperatures.

More recent attempts to deal with engine emissions have led to different approaches, one being to resort to very careful tuning of the engine toward lean mixtures and the modification of valve and ignition timing. Such procedures reduce emissions significantly, but cause substantial losses in drivability and power output and require more frequent, exacting and expensive engine maintenance. Fuel economy usually also suffers. Another technique is to provide an engine-driven pump to inject air into exhaust passages to enable the unburned fuel to be burned in the exhaust manifold. This latter system is also effective to reduce emissions, but generally results in an increase in the emission of nitrogen oxides (NOX).

From the foregoing it is apparent that there is need for an exhaust gas processing system which is far simpler and more straightforward structurally than those presently in use and which is capable of reducing the emission of air polutants to acceptable levels. It is certainly preferable that such a system accomplish this objective without imposing penalties in operation of the associated engine, such as reduced power output, rough operation, higher heating loads, higher fuel consumption and lowered reliability.

An exhaust gas processing system which does much toward alleviating some of the aforementioned disadvantages is described in U.S. Pat. No. 3,577,728, issued May 4, 1971. In this patent a number of modifications are described, but the basic arrangement consists of an exhaust pipe from an engine which directs exhaust gas flow tangentially into a cylindrical reactor chamber such that the flow is directed in a vortical pattern. A low pressure area is created along the axis of the reactor chamber, and an inlet air port is located at the upstream end through which air is caused to enter the reactor because of the lowered pressure along its axis. Despite the inclusion of ignition devices such as glow plugs and/ or spark plugs, maintaining of flame propagation through all regimes of operation proves to be a problem with devices of this nature. It is pointed out in U.S. Pat. No. 3,577,728 that in dealing with unburned carbon monoxide and hydrocarbons, whether it be through the use of a catalytic muffler arrangement, pumps for supplying outside air into the exhaust manifold, or afterburners, it is necessary to complete the combustion of the unburned carbon monoxide and hydrocarbons, and this requires all of the following:

1. Sufficient time to permit the combustion to be completed.
2. The maintenance of sufficiently high temperatures that combustion may be mantained over a long enough period to complete the combustion.
3. Sufficient oxygen to support the combustion.
4. Adequate means for mixing the added oxygen with the unburned hydrocarbons.
5. Sufficient absolute pressure to support the combustion.

If any of the foregoing five requirements are not present to a sufficient extent, there will be a reduction in the effectiveness of the hydrocarbon combustion reaction. It is also true that the presence of one or more of these factors in a wrong proportion to the others can result in increasing the requirement for others. For instance, the presence of adequate oxygen but insufficient mixing means can substantially increase the amount of time required for satisfactory combustion. Similarly, the introduction of an excess amount of oxygen at low temperatures can lower the temperature in the combustion area sufficiently either to stop the combustion altogther or to inhibit it substantially such that much extra time is required.

SUMMARY OF THE INVENTION

It is, therefore, an object of the present invention to provide an improved exhaust gas reactor for internal combustion engines which meets all of the above listed five requirements to very effectively purify the exhaust gases emitted from such engines.

The foregoing and other objects are achieved according to this invention through the provision of a vortex-type reactor device including a housing to which the exhaust gases are supplied along with additional air under pressure to aid in combustion. The housing includes a pair of series-connected cylindrical chambers with the gas inlet to the first chamber being connected tangentially to the said chamber to cause the exhaust stream to be directed tangentially against the inside cylindrical surface of the first chamber, thereby production a vortical flow pattern having high angular velocity flowing in a helical path through the length of said first chamber. A tangentially connected duct or passageway directs the flow in a similar manner into the second chamber, continuing the vortex pattern in the opposite axial direction. At the end of the second chamber the flow exits against an end wall of the housing and is redirected over the outside surfaces of one or both of the reactor chambers to preserve heat in the chambers as an aid to combustion. The flow then exits from the reactor housing to the atmosphere or to another processor such as a muffler or resonator. One or more annular washer-like flame holders are fastened to the inside surfaces of one or both of said chambers, and it is the purpose of such flame holders to retain such heat and temperature that they cause continual ignition of the gases flowing past despite intermittent reductions in the actual temperature of the engine exhaust gases. To further assure ignition of the gases in said first chamber, an igniter device which may be a spark plug is placed in said first chamber, preferably near and immediately downstream of one of said flame holders.

DESCRIPTION OF THE PREFERRED EMBODIMENT

Figure 1:
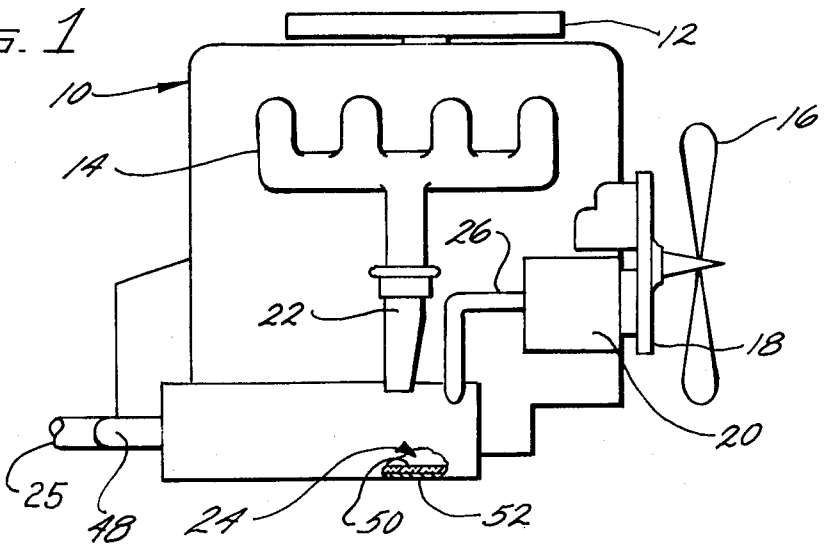
FIG. 1 is a plan view of a typical engine with my exhaust gas reactor installed.

FIG. 1 shows a typical internal combustion engine 10 including certain conventional components, such as an air cleaner 12, an exhaust manifold 14, and engine-driven fan 16 coupled by means of a conventional belt drive 18 to an air pump 20. The exhaust manifold 14 is connected to an inlet pipe 22 which is connected tangentially to an exhaust gas reactor housing 24. An outlet conduit 26 from the air pump 20 is connected, also tangentially, to the front end of reactor member 24 such that it communicates with the interior of reactor 24. The reactor 24 is connected to an exhaust pipe 25 which carries the processed exhaust gas from the engine.

Figure 2:
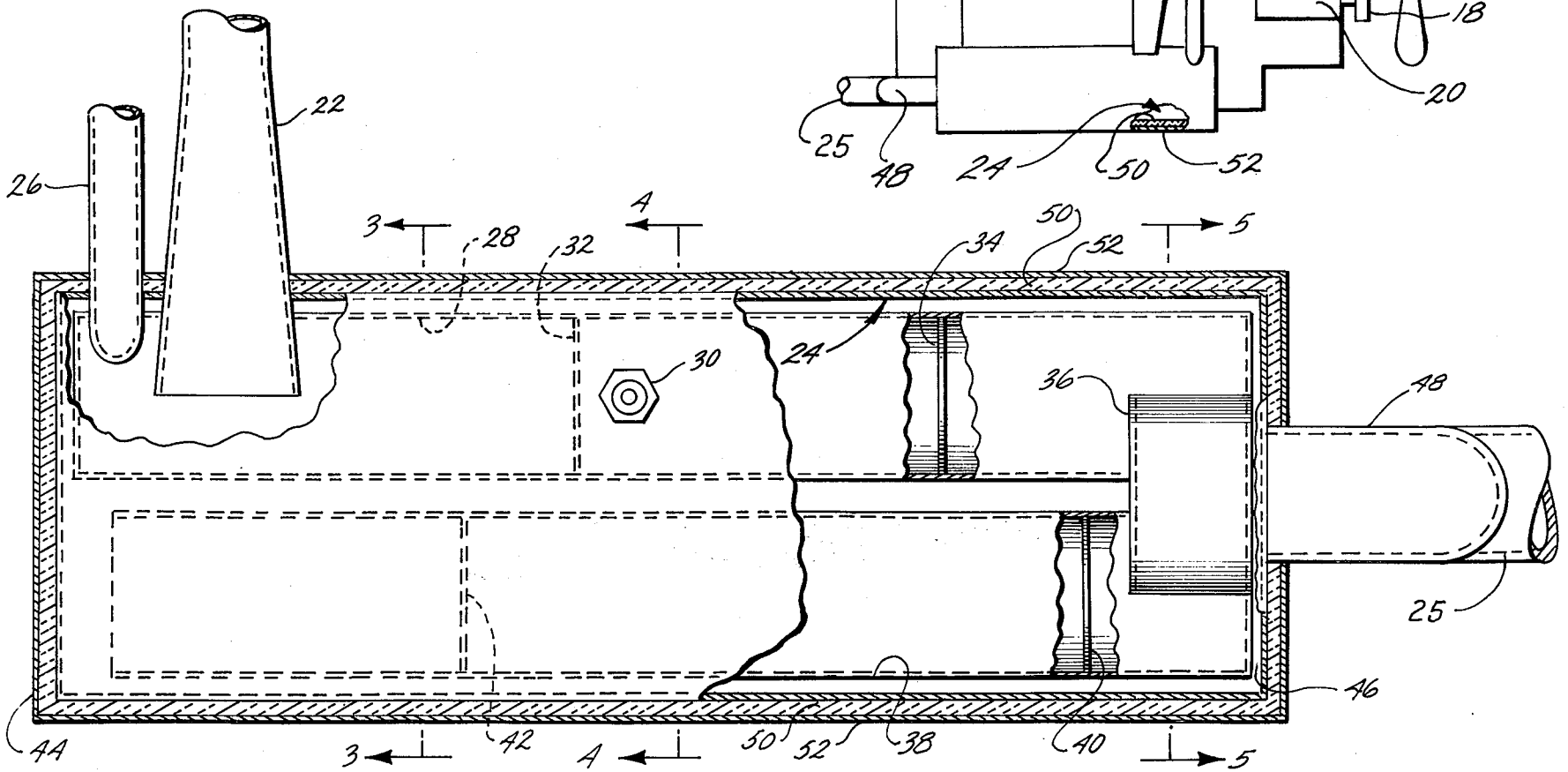
FIG. 2 is a side view, partly in section, of an exhaust gas reactor like that shown in FIG. 1.
Figure 3:
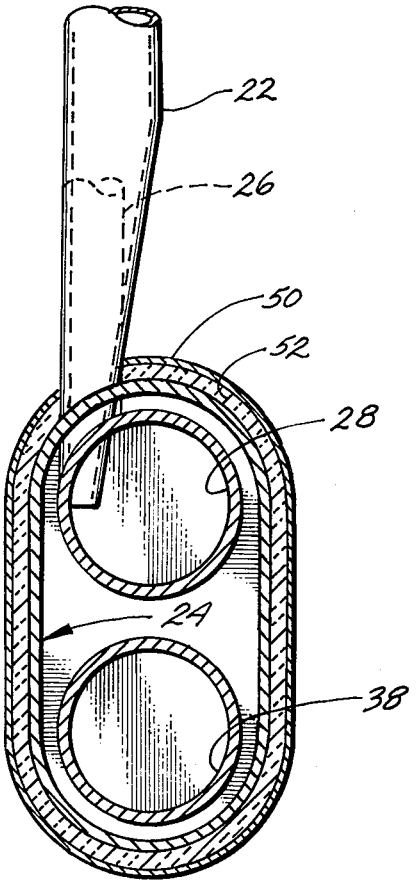
FIG. 3 is a sectional view taken along line 3—3 of FIG. 2.
Figure 4:
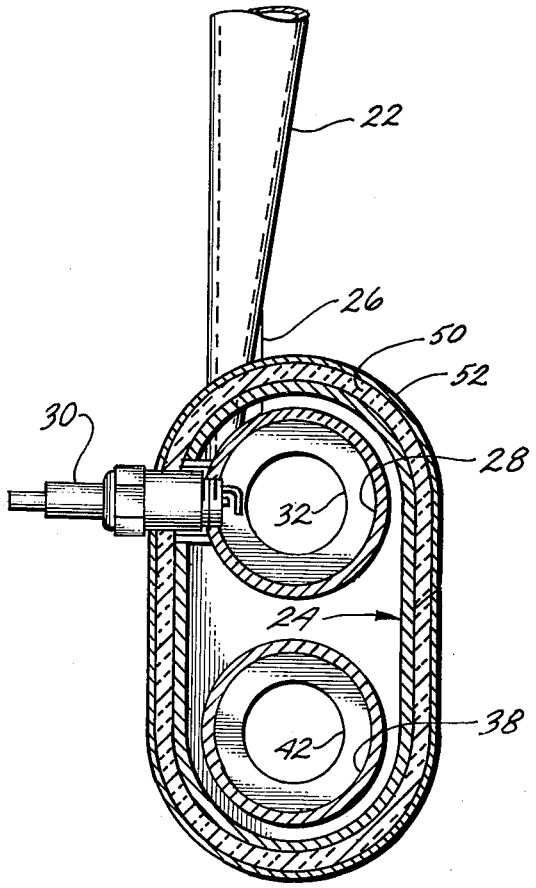
FIG. 4 is a sectional view taken along line 4—4 of FIG. 2.

FIG. 2 shows the reactor 24 partially in section and reversed, end for end compared with FIG. 1, and substantially enlarged. The inlet pipe 22 is shown at the left end of the Figure connected tangentially with respect to the cylindrical reactor housing. Pipe 22 is flattened at the end where it enters housing 24 such that flow therefrom impinges tangentially against the interior of a cylindrical chamber 28 and is constrained into a vortical flow pattern, moving spirally and axially toward the right (as seen in FIG. 2). Also connected tangentially into chamber 28 is conduit 26 which carries air under pressure from air pump 20. This air flow is also directed into a vortical flow pattern and mixes with the gas fow from pipe 22. FIG. 3, which is a sectional view taken along line 3—3 of FIG. 2, shows the tangential connections of exhaust pipe 22 and air conduit 26 with chamber 28 which produces a spiral or vortical flow pattern. This vortex flow of gas and air creates a region of high gas pressure along the wall of chamber 28. Supplying the air to the exhaust flow in this manner may, in at least some operationg regimes, be sufficient to ignite any unburned carbon monoxide of hydrocarbons present in the exhaust flow at that time. Should ignition not occur spontaneously, it can be caused to occur through the action of a spark plug 30, which is connected to receive electrical energy from the ignition system of the engine. One arrangement which has been used is to add an additional ignition coil and an additional set of ignition points for this purpose. FIG. 4, which is a sectional view taken along line 4—4 of FIG. 2, shows the spark plug 30 fastened through the side walls of housing 24 and chamber 28. An apertured disk or flame holder 32 also appears in plan view secured to the inside surface of chamber 28. Obviously spark plug 30 might also be a glow plug, a hot wire or other ignition device. Member 32 serves to force the flow of gas through its center from whence it again expands to essentially the diameter of chamber 28. Should the gas have spontaneously ignited, member 32 will be exposed to this flow of ignited gases and will become very hot, thereby serving as a flame holder and aiding in the maintenance of the combustion of the gases. A second such apertured washer 34 downstream of the spark plug 30 functions in exactly the same manner, being exposed to the ignited gas flow and, in all cases, acting as a flame holder. Flow passing flame holder 34 reaches the right end of chamber 28 and then flows into a connecting passageway 36 which directs the vortical flow of burning gases into a second cylindrical reactor chamber 28 which contains additional flame holder members 40 and 42 similar to members 32 and 34.

Figure 5:
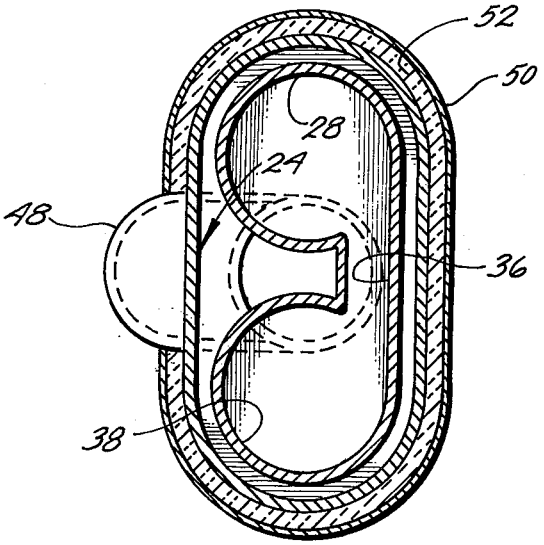
FIG. 5 is a sectional view taken along line 5—5 of FIG. 2.

Thus exhaust flow from the engine flows from the exhaust manifold 14 to inlet pipe 22 and thence to the interior of reactor chamber 28 where it is combined with air from the air pump 20, and the resultant mixture is ignited either spontaneously or through the action of the spark plug 30. This ignited vortex of gases flows past the flame holders 32 and 34 which tend to partially block axial flow and to force flow through the aperture at their centers. The burning gases impinging upon these flame holder members cause them to become extremely hot to aid in maintaining ignition while at the same time redirecting flow through their central apertures and producing a stagnation region immediately downstream. This stagnation region is effective in maintaining a flame in the reactor by preventing the flame from moving downstream during periods of high gas velocity. The flow reaching the end of chamber 28 is directed through tangential passage 36 into the second chamber 38 where it is redirected toward the left. This arrangement may be more apparent from consideration of FIG. 5, which is a section taken along line 5—5 of FIG. 2. From consideration of FIGS. 2 and 5, it will be understood that flow proceeding in a spiral (clockwise — FIG. 5) manner and reaching the wall at the end of chamber 28 will necessarily be directed through connecting passage 36 into the second cylindrical chamber 38 in such a way as to essentially retain its vortex flow pattern. The flow at this time retains a substantial amount of velocity and energy and remains very hot. As it is reversed in direction and flows toward the left, flame holder members 40 and 42 will be maintained by the burning gases in an extremely hot condition and will serve to maintain the combustion of the gases flowing therethrough. This gas flow continues in a vortex flow pattern, moving toward the left through chamber 38 and exiting from the open end of chamber 38 where it abuts against an end wall 44 of chamber 24.

This flow, which is still very hot, again reverses direction and flows toward the right along the inside wall of reactor housing 24 and between chambers 28 and 38, thereby surrounding the walls of chamber 28 and 38 until it reaches an open chamber 46 at the right end of the reactor housing 24. This flow serves to keep both sides of the walls of the chambers 28 and 38 very hot, thus preserving heat and maintaining combustion for a sufficient period to assure that essentially all combustibles are burned. From thence it is directed into an outlet passage 48 leading to the atmosphere through the exhaust pipe 25 (FIG. 1).

Since reactor 24 is quite effective as a sound attenuator, it may not be necessary to include an additional muffler in the exhaust line. Where one is considered desirable, it is usually sufficient to include a simple resonator or a straight-through "glass-pack" type rather than the usual more elaborate automotive muffler. This exhaust reactor system provides the sound attenuation function with a minimum of back pressure on the engine and will, in almost all cases, provide as good as, or better, scavenging than that obtained with a conventional exhaust system.

Because of the folded construction described, the reactor 24 generates and retains intense heat, and its outside surface becomes too hot, in most applications, for direct exposure to the environment. It thus becomes necessary to wrap housing 24 in a layer of insulating material 50 which may be of a ceramic fiber type such as is commonly used in heating systems. This layer may also be protected with an additional cover 52, if considered necessary or desirable.

Modifications will occur to those skilled in the art. While the injection of air in a tangential manner is usually preferable, it has not in all cases been necessary to provide adequate performance of the reactor. And one configuration which has been effective in some applications includes a second chamber of larger diameter telescoping over the first chamber, with both enclosed in a housing redirecting flow over the outside chamber. This has some disadvantages in that the vortex action tends to slow with the greater diameter of the second chamber, and the reactor tends to have a rather large cylindrical configuration which is often difficult to accommodate in the available space. The number and placement of the annular flame holder members is subject to some variation, but that disclosed herein is the best which has been found for most applications.

I claim:

1. An exhaust gas processing device for use with a combustion engine comprising:

an exhaust inlet pipe connected to receive the gaseous combustion product from said engine;

a reactor member including a housing containing first and second nonconcentric side by side chambers of substantially cylindrical cross-section, each of said chambers being spaced from said housing and a passage comprising a duct interconnecting said chambers tangentially with respect to each said chamber, air inlet means communicating with said first chamber, an exhaust outlet from said housing, an exhaust inlet port in the side wall of said first chamber at one end thereof, said exhaust pipe connecting with said exhaust inlet port substantially tangentially with respect to said first chamber and causing the exhaust stream to be directed tangentially against the cylindrical surface of said first chamber in a plane almost perpendicular to the axis of said chamber whereby said exhaust stream is constrained into a vortical pattern having high angular velocity in a helical path flowing toward said interconnecting passage, through said passage to said second chamber thereby continuing said vortical flow pattern in a reverse axial direction through said second chamber and abutting against an end wall of said housing and being again redirected axially over at least the outside wall of one of said chambers before being exhausted to the atmosphere, at least one annular flame holder member extending from the inside wall of said first chamber toward its axis and exposed to said exhaust stream, ignition means in said first chamber exposed to said exhaust stream, and an engine-driven air pump for supplying compessed are to said air inlet means.

2. An exhaust gas processing device for use with a combustion engine as set forth in claim 1 wherein said air inlet means supplies air to said first chamber tangentially with respect to said chamber.

3. An exhaust gas processing device for use with a combustion engine as set forth in claim 1 wherein said air inlet means is connected to said first chamber upstream of said exhaust inlet port.

4. An exhaust gas processing device for use with a combustion engine as set forth in claim 1 wherein at least one annular flame holder member is located in each of said first and second chambers.

5. An exhaust gas processing device for use with a combustion engine as set forth in claim 1 wherein one annular flame holder member is positioned upstream of said ignition means.

6. An exhaust gas processing device for use with a combustion engine as set forth in claim 1 wherein a plurality of annular flame holders members are located in each of said first and second chambers.

7. An exhaust gas processing device for use with a combustion engine as set forth in claim 1 wherein said ignition means is a spark plug positioned adjacent said annular flame holder member.

8. An exhaust gas processing device as set forth in claim 1 wherein flow from said second chamber is redirected axially within said housing over the outside walls of both said first and second chambers.

9. An exhaust gas processing device as set forth in claim 2 wherein said housing includes an inside shell, a layer of thermal insulation surrounding said shell and a cover surrounding and enclosing said insulation layer, said air inlet means is connected to said first chamber upstream of said exhaust inlet port, and flow from said second chamber is redirected axially within said housing over the outside walls of both said first and second chambers.

* * * * *